US006204613B1

(12) United States Patent
Hesterman

(10) Patent No.: US 6,204,613 B1
(45) Date of Patent: Mar. 20, 2001

(54) PROTECTED DIMMING CONTROL INTERFACE FOR AN ELECTRONIC BALLAST

(76) Inventor: Bryce L. Hesterman, 113 Bellingham Dr., Madison, AL (US) 35758

( * ) Notice: Subject to any disclaimer, the term of this patent is extended or adjusted under 35 U.S.C. 154(b) by 0 days.

(21) Appl. No.: 09/507,425

(22) Filed: Feb. 18, 2000

(51) Int. Cl.[7] ..... H05B 37/02
(52) U.S. Cl. ..... 315/291; 315/307; 315/DIG. 4
(58) Field of Search ..... 315/DIG. 4, 291, 315/224, 244, 307, DIG. 5

(56) References Cited

U.S. PATENT DOCUMENTS 5,003,230 3/1991 Wong et al. .
5,039,914 8/1991 Szuba .
5,089,751 2/1992 Wong et al. .
5,583,402 12/1996 Moisin et al. .
5,751,118 5/1998 Mortimer .

*Primary Examiner*—David Vu
(74) *Attorney, Agent, or Firm*—Waddey & Patterson; Larry W. Brantley

(57) ABSTRACT

A dimming control interface for dimming ballasts is disclosed. The control interface includes DC voltage source input terminals in series with a pair of input terminals and a high-voltage resistance element to form a current source. The dimming control interface includes an isolated coupling element connected between a pair of dimming control input terminals and a pair of dimming control output terminals, and is operative to generate an output control voltage in response to an input control voltage applied to the input terminals. The dimming control interface further includes voltage clamping element to limit voltages generated in the control interface to safe levels when an external AC power source is connected to the dimming control interface. Similarly, a second high voltage resistance element is connected between one of the dimming control input terminals and the isolated coupling element to limit currents generated by the AC power source to safe levels.

21 Claims, 5 Drawing Sheets

PROTECTED DIMMING CONTROL INTERFACE FOR AN ELECTRONIC BALLAST

BACKGROUND OF THE INVENTION

The present invention relates generally to dimming electronic ballasts used to power gas discharge lamps. Specifically, this invention pertains to a 0–10 volt dimming control interface for an electronic ballast that includes components that will prevent the dimming control interface from being damaged if it is accidentally connected to an external AC power source. More specifically, the dimming control interface of the present invention includes circuits that limit voltages and currents present in the dimming control interface circuit to safe levels when the external AC power source is connected to the dimming interface circuit.

Generally, a 0–10 volt dimming control interface is designed to be connected to a DC control voltage, while the ballast itself is designed to be connected to an external AC power source. A conventional 0–10 volt control interface is designed to deliver a small current preferably ranging from about 300 $\mu$A to 500 $\mu$A. Consequently, a typical DC control voltage may be obtained from a variable resistor, a shunt controller, or a more sophisticated light-level controller. Shunt controllers control ballasts by setting the voltage between the control input terminals to a level ranging from 0 volts to 10 volts. If the shunt controller is disconnected from the dimming control interface, the open-circuit voltage between the control input terminals will rise to approximately 10 volts.

To allow these connections, dimming ballasts usually include a pair of dimming control input terminals designed to be connected to the DC control voltage, and a pair of AC power input terminals designed to be connected to the external AC power source. Sometimes, however, the AC power source is accidentally connected to the dimming control input terminals rather than the AC power input terminals. As a result, the dimming control interface and the ballast may be damaged by excessive currents and voltages generated by the AC power source. Replacement of the damaged dimming control interface and/or the ballast is an expensive proposition. Thus, there is a need for a dimming control interface that may be connected to a DC control voltage, as well as, an external AC power source without being damaged.

To complicate matters even more, a dimming control interface may be connected to several different ballasts through a single pair of dimming control input terminals. When the external AC power source is connected to such a dimming control interface, excessive currents and voltages generated by the AC power source may damage several ballasts. Replacement of multiple dimming control interfaces and/or ballasts is accordingly more expensive and undesirable. Thus, there is an additional need for a dimming control interface that may be connected to an external AC power source without being damaged.

Although dimming control interface circuits are well known in the art, there are no known dimming control interfaces that are capable of withstanding a sustained connection to an external AC power source without being damaged. For example, one known dimming control interface is described in U.S. Pat. No. 5,751,188 issued to Mortimer on May 12, 1998 and entitled "Universal Input Dimmer Interface." This patent teaches a dimming control interface that may be connected to an external DC control voltage or an external pulse-width modulated control voltage. In either case, the dimming control interface includes circuitry for generating an electrically isolated control voltage at output terminals on the dimming control interface in response to the input control voltage applied at input terminals on the dimming control interface, whether the input control voltage is the DC control voltage or the pulse-width modulated control voltage. This patent fails to teach or suggest the use of any circuits for the purpose of limiting currents and voltages present in the dimming ballast when an external AC voltage is applied to the dimming control input terminals.

Another example is described in U.S. Pat. No. 5,583,402 issued to Moisin et al. on Dec. 10, 1996 and entitled "Symmetry Control Circuit and Method." This patent also teaches a dimming interface circuit designed to be connected to either a DC control voltage or a pulse-width modulated voltage signal. As was the case with the '188 patent, this patent fails to teach or suggest the use of circuits designed to limit currents and voltages present in the dimming ballast when an AC power source is connected.

Two additional examples of dimming control interfaces are described in U.S. Pat. No. 5,089,751 issued to Wong et al. on Feb. 18, 1992 and entitled "Fluorescent Lamp Controllers with Dimming Control," and U.S. Pat. No. 5,003,230 issued to Wong et al. on Mar. 26, 1991 and entitled "Fluorescent Lamp Controllers with Dimming Control." Neither of these patents teach a dimming control interface that includes protection from connection of the dimming input terminals to an external AC power source.

In addition, there are two known commercial dimming control interfaces. A portion of a one such prior-art dimming control interface circuit is shown in FIG. 1. A small-signal PNP transistor Q1 is connected to a biasing circuit (not shown) so that the transistor will supply about 400 $\mu$A current to a shunt controller (not shown) connected between control input terminals J1 and J2. A zener diode D1 prevents the voltage between terminals J1 and J2 from rising above about 10 V if no shunt controller is connected to the circuit. An isolated coupling circuit (not shown) may be connected between terminals J3 and J5. The isolated coupling circuit sends a dimming control signal to a ballast inverter circuit (not shown). A resistor R1 provides protection for the interface circuit if the control terminals should accidentally be connected to a low voltage source such as a 24 VAC control line. R1 typically has a value of about 1 kΩ, so the 0.4 V voltage drop due to the 400 $\mu$A current is small in comparison with 10 V, and can be compensated for. It is impractical to make R1 large enough in value to withstand ac power line voltages because the voltage that would then be dropped across it due to the 400 $\mu$A current would be large in comparison with 10 V.

A portion of another commercial dimming control interface is shown in FIG. 2. A floating 12 V dc power supply (not shown) is connected between terminals J14 and J15, with the positive terminal connected to J14. Resistors R2 and R3 have a value of 10 kΩ. They supply current to control input terminal J11 through a high voltage diode D2. A high-voltage N-Channel power MOSFET transistor Q2 is biased on by resistors R2 and R3 when terminal J11 is positive with respect to J12, which is the case during normal operation. During normal operation, the voltage between terminals J13 and J15 is about 0.6 V less than the voltage between terminals J11 and J12. The voltage between terminals J13 and J15 is coupled to a regulator circuit consisting of an operational amplifier U1, resistors, R4, R5 and R6, a capacitor, C1, and a current sensor circuit 10. The input terminals of an optocoupler (not shown) are connected between terminals J16 and J15. The current sensor provides a signal that is proportional to the lamp current. This signal provides negative feedback even though it is connected to the positive terminal of U1 because the optocoupler is connected to the ballast inverter (not shown) in a way that decreases lamp current when the input current to the optocoupler increases.

If the voltage between terminals J11 and J12 becomes negative, Q2 is turned off, and this protects the regulator circuit. If the voltage between terminals J11 and J12 becomes greater than about 11 V, diode D2 becomes reverse biased, and this also protects the regulator circuit. If the blocking capabilities of D2 and Q2 were each about 600 V, then the regulator circuit would be protected if terminals J11 and J12 were connected across a 277 V power line that had no transients. This dimming interface circuit is more robust than conventional 0–10 V dimming interfaces, but it is excessively costly because it includes a high-voltage diode and a high-voltage power MOSFET transistor. In addition, there are transient voltages that commonly occur on ac power lines, and diode D2 and transistor Q2 could be destroyed by these transients. Furthermore, the active dimming range is from 0.1 V to 6.6 V, while many shunt controllers, particularly manual types with slide controls, are designed to operate from about 1 to 9 V. Finally the current sourced by the control terminals is only 48 $\mu$A at 10 V, and some controls require 200 $\mu$A.

What is needed, then, is a dimming control interface that provides a current ranging from 300 $\mu$A to 500 $\mu$A in response to a DC control voltage ranging from 0–10 volts, and limits the voltages and currents present in the dimming control interface to safe levels when an external AC power source is accidentally connected to the dimming control input terminals.

SUMMARY OF THE INVENTION

The present invention includes a dimming control interface designed to be used with an external dimming control device, such as a shunt controller, to provide a dimming control output voltage to a ballast. In addition, the present invention includes additional circuitry designed to protect the dimming control interface from excessive currents and voltages that may be generated when the dimming control interface is connected to an external AC power source. As such, the dimming control interface includes a current source connected to a pair of input terminals and designed to provide a current to the input terminals when the external dimming control device is connected to the input terminals. The current source includes a high voltage resistor for limiting the current supplied to the input terminals when they are connected to an external AC power source. An isolated coupling circuit is connected between the input terminals and a pair of dimming control output terminals, and is operative to generate an output control voltage in response to an input control voltage applied to the input terminals. A clamping circuit and a second high voltage resistor are connected between the input terminals and the isolated coupling circuit, and are designed to limit the currents and voltages generated in the dimming control interface when an AC power source is connected to the input terminals. An alternative embodiment of the isolated coupling circuit is disclosed and includes an error amplifier that is connected to a current sensor circuit and to the input terminals.

DESCRIPTION OF THE PREFERRED EMBODIMENTS

Figure 3:
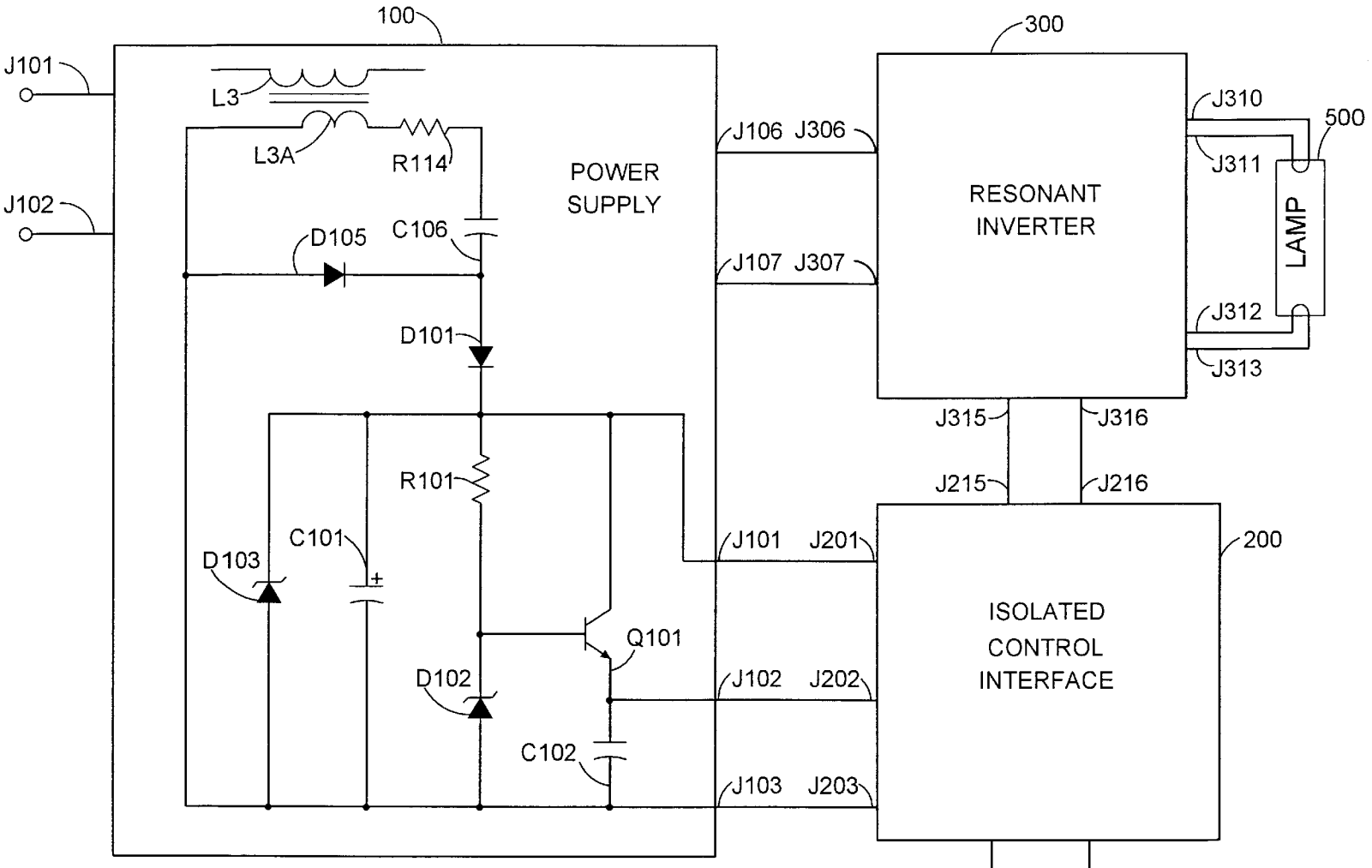
FIG. 3 is a simplified schematic diagram of a dimmable electronic ballast.

Referring to FIG. 3, a simplified schematic diagram of an electronic dimming ballast is shown. The ballast has an ac-dc power supply 100 that has ac input terminals J101 and J102 for connection to an ac power line. The main dc output of the power supply is provided between a first set of dc output terminals J106 and J107. These output terminals are connected to dc input terminals J306 and J307 of a resonant inverter 300.

An inductor L3 is part of a typical boost power factor correction circuit (not shown) that provides power to terminals J106 and J107. When the power supply is operating, an ac voltage is developed across winding L3A. This voltage is rectified by a charge-pump circuit comprising a resistor R114, a capacitor C106, and diodes D101 and D105. The rectified output of the charge-pump circuit is filtered by a capacitor C101, and regulated to a value of about 32 V by a zener diode D103. This voltage is supplied to a second set of dc output terminals, J101 and J103 that are electrically isolated from terminals J101 and J102. A 15 V regulator circuit is connected to the 32 V supply, and consists of a resistor R101, a zener diode D102, a small-signal NPN transistor Q101, and a bypass capacitor C102. The output of the 15 V regulator circuit is connected to terminal J102. The 32 V and 15 V power supplies described above are simple, low-cost circuits. They are not novel, and other known power supply circuits may be used.

An isolated control interface 200 (also referred to as a dimming control interface) has dc supply input terminals J201, J202, and J203 that are connected, respectively, to terminals J101, J102, and J103 of power supply 100. Control interface 200 has control input terminals J205 and J204 that are intended to provide a current for operating a 0–10 V dimming control (not shown) that functions as a shunt controller. Control interface 200 provides a dimming control output signal at control output terminals J215 and J216. The dimming control output signal at control output terminals J215 and J216 is controlled by the control input voltage between control input terminals J205 and J204. Control output terminals J215 and J216 are electrically isolated from control input terminals J205 and J204.

Resonant inverter 300 has dimming control input terminals J315 and J316 that are connected, respectively, to control output terminals J215 and J216. A lamp 500 is connected to the resonant inverter through terminals J310, J311, J312, and J313. The resonant converter may be constructed to supply additional lamps (not shown). The voltage between dimming control input terminals J315 and J316 controls the lamp current supplied by the resonant inverter. Thus the isolated control interface allows the control voltage between control input terminals J205 and J204 to control the lamp current supplied by the resonant inverter.

Figure 1:
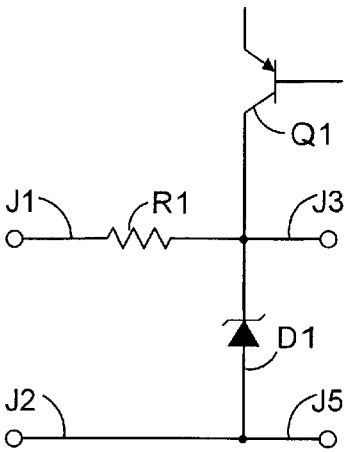
(prior art) FIG. 1
FIG. 1 is a circuit diagram of a portion of a prior art 0–10 volt dimming control interface circuit.
Figure 4:
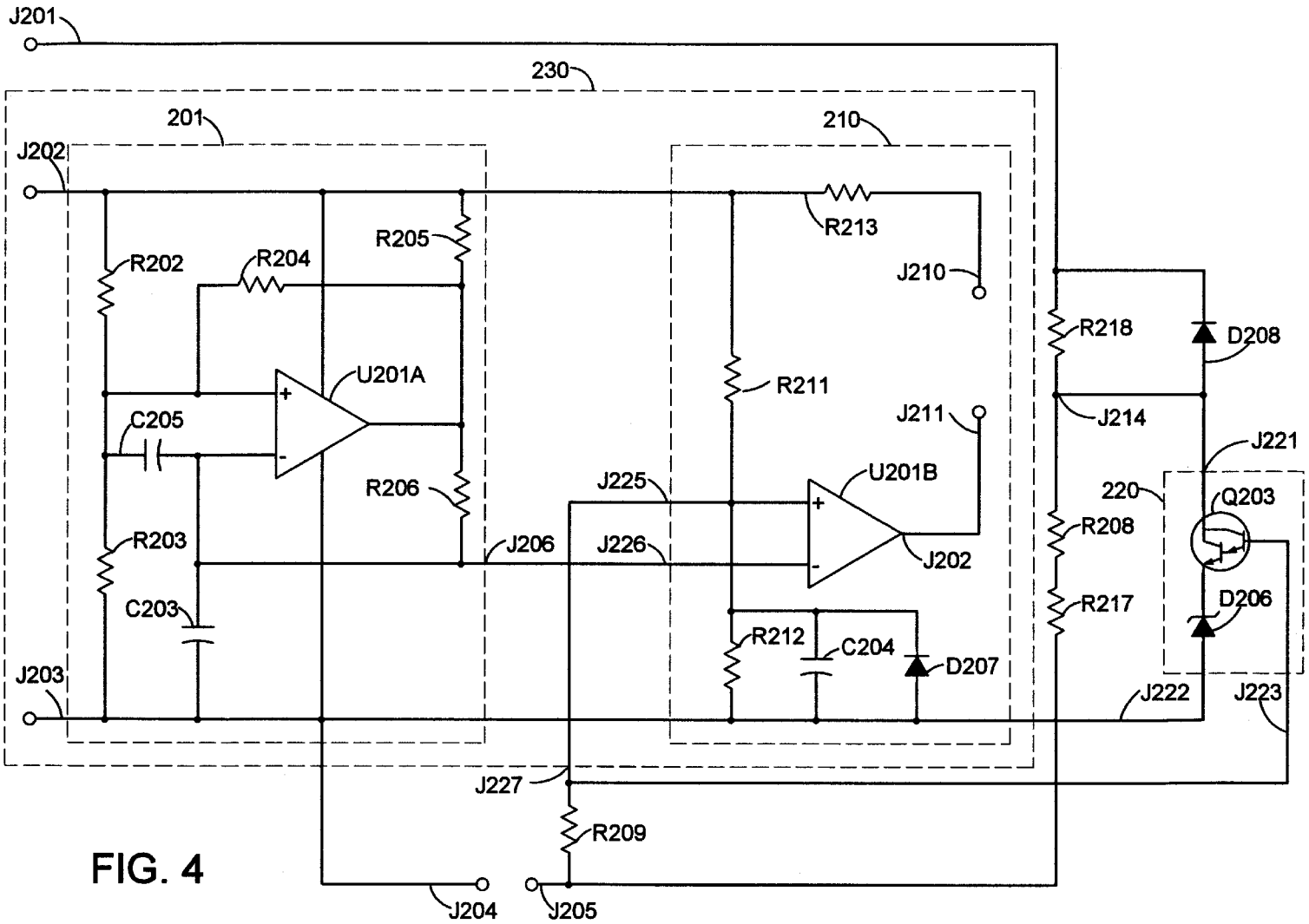
FIG. 4 is a circuit diagram of one embodiment of the present invention of a 0–10 volt dimming control interface.

Referring to FIG. 4, a 4.7 kΩ resistor R218, and two 33 kΩ resistors R208 and R217 are connected in series between the 32 V supply and control input terminal J205 to form a simple current source. When an external dimming control is connected to the control input terminals, the current source provides a current to the dimming control that ranges from about 300 $\mu$A when the control voltage is 10 V to about 500 $\mu$A when the control voltage is zero. A 32 V supply is used so that the current source will be able to supply adequate current when the control voltage is 10V. Because the 32 V supply is higher than the desired maximum open-circuit control voltage level of 10 V, a clamping circuit must be utilized. The preferred place for the clamping to occur is at an intermediate terminal, junction J214, because this allows resistors R208 and R217 to prevent excessive current from flowing into control input terminals J205 and J204 when excessive voltages are applied. The clamping circuit cannot be just a zener diode as in FIG. 1, because junction J214 must have a voltage greater than 10 V with respect to junction J204 under normal operating conditions.

A clamping circuit 220 was developed as part of the present invention to allow terminal J214 to be clamped only when necessary. Clamping circuit 220 has a common terminal J222, a clamp terminal J221, and a sense terminal J223. Clamping terminal J221 is connected to an intermediate terminal J214 in the current source resistor string. Common terminal J222 is connected to control input terminal J204. Sense terminal J223 is coupled through resistor R209 to control terminal J205. Clamping circuit 220 consists of an NPN Darlington transistor Q203 and a 9.1 V zener diode D206. Under open-circuit conditions, the control voltage rises until the voltage at sense terminal J223 reaches about 10V, and Darlington transistor Q203 turns on. This reduces the voltage at terminal J214 to about 10 V as current flows from terminal J214 through terminal J221 to terminal J222. The clamping circuit therefore limits the open-circuit value of the control voltage to about 10 V while resistors R209, R208, and R217 prevent excessive current from flowing into control input terminals J205 and J204 when excessive voltages are applied.

If a large ac voltage should inadvertently be applied between control input terminals J205 and J204, the voltage at a modulator input terminal J227 will be clamped in the positive direction to about 10 V because of the low impedance path between the sense and common terminals of clamp circuit 220 that consists of two forward-biased emitter-base junctions of transistor Q203 and zener diode D206. Resistor R209 consists of a high voltage resistor, or a series string of smaller resistors (such as three surface-mount resistors) having a total resistance value of about 240 kΩ.

This limits the currents flowing into terminals J227 and J223 to safe levels.

Figure 2:
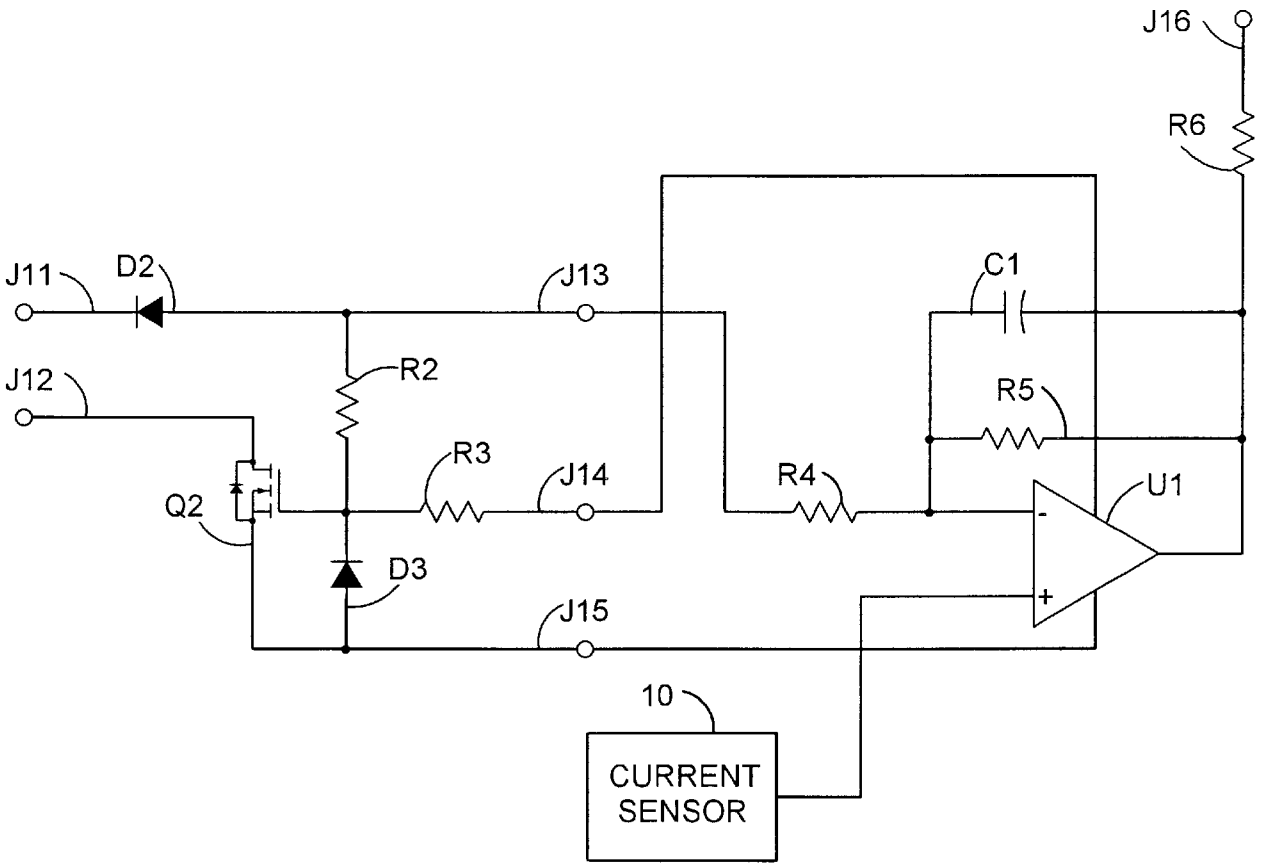
(prior art) FIG. 2
FIG. 2 is a circuit diagram of a portion of another prior art 0–10 volt dimming interface circuit.

For large negative swings of the control voltage, the voltage at terminal J227 is limited to about −0.7 V by a diode D207 that is connected between terminals J227 and J204. Again, resistor R209 limits the currents to safe values. Resistors R208 and R217 are each rated at 1 W so that they can operated indefinitely with an ac voltage of 277 V rms applied between the control input terminals. A diode D208 is connected in parallel with resistor R218 so that the collector-to-emitter voltage of transistor Q203 is limited to a safe value when a large ac voltage is applied between the control input terminals. The control interface 200 has been tested by connecting control input terminals J204 and 205 to ac input terminals J101, and J102. The control interface is so robust that it is not damaged by 2.5 kV power line transients. In contrast, transistor Q2 and diode D2 in FIG. 2 would be destroyed by transients of that level.

Figure 5:
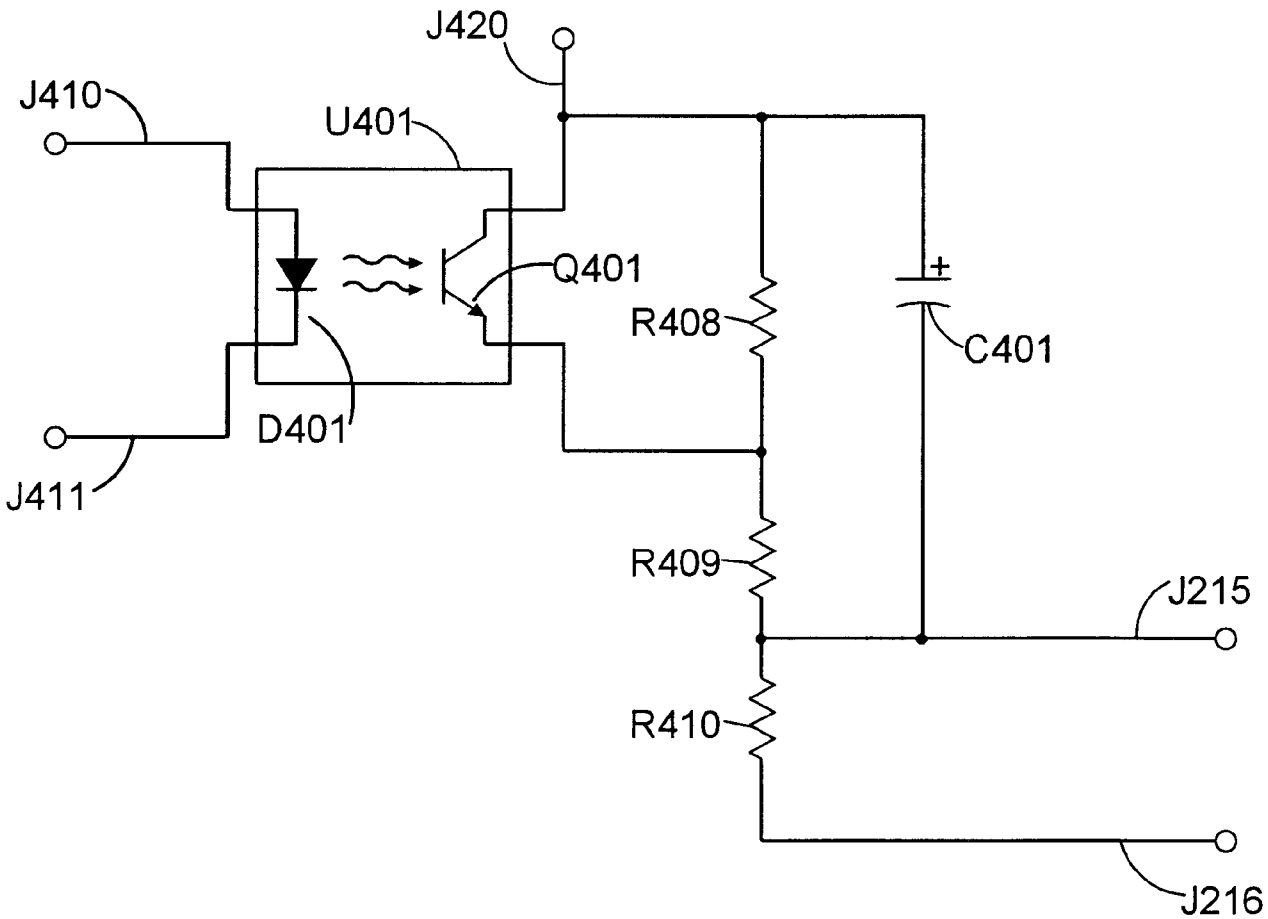
FIG. 5 is a circuit diagram of a coupling circuit used in one embodiment of the present invention.

Control input terminal J205 is coupled to modulator input terminal J227 of a pulse-width modulator circuit 230 through a resistor R209. The pulse-width modulator has output terminals, J210 and J211, that are connected to input terminals, J410 and J411, of an optocoupler U401 that is shown in FIG. 5. As is explained in further detail below, the optocoupler and other the circuitry shown in FIG. 5 produce a control output voltage between terminals J215 and J216 that is directly related to the control input voltage. The lamp current is therefore controlled by the voltage between the modulator input terminal and control input terminal J204. The lamp current will have its maximum value when the control input terminals are disconnected, and it will have a minimum value when the control input terminals are shorted together.

The control input voltage is ideally a dc signal, but noise signals may be present between control input terminals J205 and J204. Consequently, a 0.1 $\mu$F capacitor C204 is connected from J227 to J204 in order to filter out ac signals. If a large ac voltage is connected between control input terminals J205 and J204, the voltage between J227 to J204 will be at a level that produces a lamp current that is about 30 percent of the maximum value. This level is much less than the maximum value, and much greater than the minimum value, typically 5 percent. Thus, if the control input terminals should accidentally be connected across an ac power line, the ballast will function, but the lamp current cannot be controlled. Instead, it will be at an intermediate value that will be distinguishable from fault conditions in which the control input terminals are shorted or opened by observation of the lamp brightness.

Pulse-width modulator 230 is comprised of an oscillator circuit 201 and a comparator circuit 210. The oscillator circuit is comprised of an open-collector comparator U201A, capacitors C203 and C205, and resistors R202, R203, R204, R205, and R206. The oscillator circuit produces a triangle wave with a frequency of about 240 Hz at an oscillator output terminal J206, which is connected to a negative comparator input terminal J226. Pulse-width modulator input terminal J227 is connected to a positive comparator terminal J225. Terminals J225 and J226 are connected to the input terminals of a second open collector comparator, U201B. Comparators U201A and U201B may be contained within a single integrated circuit such as an LM393 from National Semiconductor. Resistors R211 and R212 provide biasing to the positive input terminal of U201B to level-shift and scale the signal coupled through R209 to match the oscillator output signal present at negative comparator input terminal J226. The duty cycle of the open-collector output of U201B is zero (the output voltage is high) when the control voltage present between terminals J205 and J204 is less than about 1 V, and it increases to 100 percent when the control voltage reaches about 9 V.

Referring to FIG. 5, a light-emmiting-diode (LED) D401 of optocoupler U401 is on when the open-collector output of U201B is on. Resistor R213 limits the diode current to a safe level. A phototransistor Q401 is on when diode D401 is on. A 5 V voltage source (not shown) is connected between terminals J420 and J216. A capacitor C401 and resistors R408, R409, and R410 are connected to transistor Q401 and terminals J430, J215, and J216 so that the voltage between control output terminals J215, and J216 is directly related to the duty cycle of transistor Q401.

Figure 6:
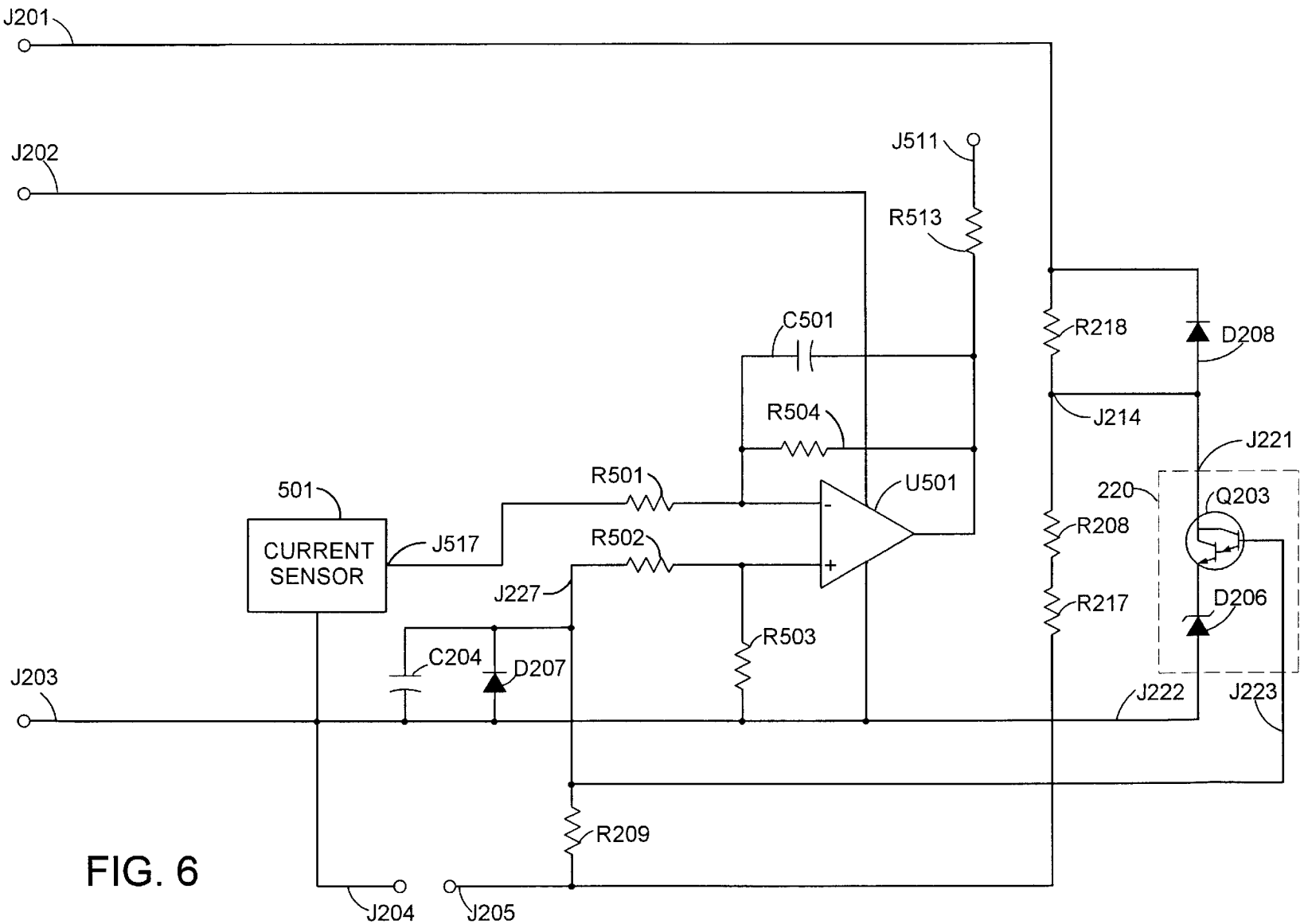
FIG. 6 is a circuit diagram of an alternative embodiment of the present invention of a 0–10 volt dimming control interface.

An alternative embodiment of the present invention of a dimming control interface is shown in FIG. 6. In this embodiment, the optocoupler is operated in a linear mode as is done in the prior-art circuit shown in FIG. 2. The current source and clamp circuits are the same as in FIG. 4. The voltage between terminals J227 and J203 is proportional to the control voltage. The voltage at terminal J227 is scaled by resistors R502 and R503, and coupled to the positive input of an operational amplifier U501, which functions as an error amplifier. A current sensor circuit 501 produces a negative feedback signal at terminal J517 that is directly related to the lamp current. The current sensor circuit may include a current transformer and a rectifier circuit. It may be also include a biasing circuit in the current sensor so that the output voltage will be greater than zero for zero lamp current. Typically the bias circuit would be adjusted so that the minimum lamp current occurs when the control voltage is about 1 V. The gain of the error amplifier is set with resistors R501, R504 and C501. An optocoupler (not shown) can be connected between terminal J511 and either terminal J202 or J203. A resistor R513 limits the current supplied to the optocoupler.

Thus, although there have been described particular embodiments of the present invention of a new and useful Dimming control interface, it is not intended that such references be construed as limitations upon the scope of this invention except as set forth in the following claims.

The invention claimed is:

1. A dimming control interface having input terminals and output terminals, comprising:

an isolated coupling circuit in communication with the input terminals and the output terminals operative to generate a control output voltage between the output terminals in response to a control input voltage generated at the input terminals by an external dimming control device, the output terminals electrically isolated from the input terminals;

a current source in communication with the input terminals operative to provide a current to the external dimming control device when the external dimming control device is connected across the input terminals, the current source including a first high voltage resistor for limiting a current flowing into the input terminals when an external AC power source is connected to the input terminals;

a voltage clamping circuit in communication with the isolated coupling circuit and the input terminals operative to limit a voltage developed between the input terminals to a predetermined level when the external dimming control device is disconnected from the input terminals and operative to limit a voltage developed at an intermediate terminal to a predetermined level when an external AC power source is connected to the input terminals; and a second high voltage resistor connected between the input terminals and the isolated coupling circuit for limiting the current flowing between the input terminals when the external AC power source is connected to the input terminals.

2. The dimming interface of claim 1, wherein the isolated coupling circuit includes:

a pulse-width modulator in communication with the input terminals and operative to generate a pulse-width-modulated voltage signal in response to the control input voltage applied to the input terminals; and an optocoupler circuit in communication with the pulse-width modulator and the output terminals operative to generate the control output voltage in response to the pulse-width-modulated voltage signal.

3. The dimming interface of claim 1, wherein the current provided to the external dimming control device ranges from approximately 300 to 500 microamperes.

4. The dimming interface of claim 1, wherein the voltage developed between the input terminals is limited to approximately 10 volts when the external dimming control device is disconnected from the input terminals.

5. The dimming interface of claim 1, wherein the isolated coupling circuit includes:

an error amplifier in communication with the input terminals and a current sensor, the error amplifier operative to generate a first voltage signal in response to the control input voltage applied to the input terminals and an output of the current sensor; and an optocoupler circuit in communication with the error amplifier and the output terminals operative to generate the control output voltage in response to the first voltage signal.

6. The dimming control interface of claim 5, wherein the current sensor comprises a current transformer in communication with a rectifier circuit.

7. The dimming control interface of claim 6, wherein the current sensor includes a biasing circuit.

8. The dimming interface of claim 1, wherein the clamping circuit includes:

an NPN transistor in communication with the input terminals and a zener diode operative to limit the voltage developed at the input terminals to a predetermined voltage when the external dimming control device is disconnected from the input terminals and to limit the voltage at the intermediate terminal to a predetermined voltage when the external ac power source is connected to the input terminals.

9. The dimming control interface of claim 1, wherein the isolated coupling circuit is operative to generate a first control output voltage when the control input terminals are shorted together, a second control output voltage when the control input terminals are disconnected, and a third control output voltage when the external ac power source is connected to the control input terminals, the second output voltage being greater than the first output voltage and the third output voltage being greater than the first output voltage but less than the second output voltage.

10. A dimming control interface having input terminals and output terminals, comprising:

an isolated coupling means in communication with the input terminals and the output terminals operative to generate a control output voltage between the output terminals in response to a control input voltage generated at the input terminals by an external dimming control device, the output terminals electrically isolated from the input terminals;

a current source means in communication with the input terminals operative to provide a current to the external dimming control device when the external dimming control device is connected across the input terminals, the current source means including a first high voltage resistance means for limiting a current flowing into the input terminals when an external AC power source is connected to the input terminals;

a voltage clamping means in communication with the isolated coupling circuit and the input terminals operative to limit a voltage developed between the input terminals to a predetermined level when the external dimming control device is disconnected from the input terminals and operative to limit a voltage developed at an intermediate terminal to a predetermined level when an external AC power source is connected to the input terminals; and a second high voltage resistance means connected between the input terminals and the isolated coupling circuit for limiting the current flowing between the input terminals when the external ac power source is connected to the input terminals.

11. The dimming interface of claim 10, wherein the isolated coupling means includes:

a pulse-width-modulator means in communication with the input terminals and operative to generate a pulse-width-modulated voltage signal in response to the control input voltage applied to the input terminals; and an optocoupler means in communication with the pulse-width-modulator means and the output terminals operative to generate the control output voltage in response to the pulse-width-modulated voltage signal.

12. The dimming interface of claim 10, wherein the current provided to the external dimming control device ranges from approximately 300 to 500 microamperes.

13. The dimming interface of claim 10, wherein the voltage developed between the input terminals is limited to approximately 10 volts when the external dimming control device is disconnected from the input terminals.

14. The dimming interface of claim 10, wherein the isolated coupling means includes:

an error amplifier means in communication with the input terminals and a current sensor means, the error amplifier means operative to generate a first voltage signal in response to the control input voltage applied to the input terminals and an output of the current sensor means; and an optocoupler means in communication with the error amplifier means and the output terminals operative to generate the control output voltage in response to the first voltage signal.

15. The dimming control interface of claim 14, wherein the current sensor means comprises a current transformer in communication with a rectifier circuit.

16. The dimming control interface of claim 15, wherein the current sensor means includes a biasing circuit.

17. The dimming interface of claim 10, wherein the voltage clamping means includes:

an NPN transistor in communication with the input terminals and a zener diode operative to limit the voltage developed at the input terminals to a predetermined voltage when the external dimming control device is disconnected from the input terminals and to limit the voltage at the intermediate terminal to a predetermined voltage when the external ac power source is connected to the input terminals.

18. The dimming control interface of claim 10, wherein the isolated coupling means is operative to generate a first control output voltage when the input terminals are shorted together, a second control output voltage when the input terminals are disconnected, and a third control output voltage when the external ac power source is connected to the input terminals, the second output voltage being greater than the first output voltage and the third output voltage being greater than the first output voltage but less than the second output voltage.

19. An isolated control interface, comprising:

first (J201) and second (J203) dc input terminals;

a first resistance means (R218) connected between the first dc input terminal and an intermediate terminal (J214);

a second resistance means (R208 and R217) connected between the intermediate terminal and a first control input terminal (J205);

a second control input terminal (J204) coupled to the second dc input terminal;

the isolated control interface operative to develop a current-limited control voltage between the first and second control input terminals, the control voltage having an open-circuit voltage level when no current is drawn from the first and second control input terminals;

voltage clamping means (220) having a common terminal (J222), a sense terminal (J223), and a clamping terminal (J221), the sense terminal coupled to the first control input terminal through a third resistance means (R209), the common terminal coupled to the second control input terminal, and the clamping terminal coupled to the intermediate terminal;

the voltage clamping means operative to provide a conductive path between the clamp terminal and the common terminal when the control voltage rises to a pre-determined level such that the open-circuit value of the control voltage is limited to the pre-determined level; and isolated coupling means for coupling a signal from the control input terminals to first (J215) and second (J216) control output terminals, the control output terminals being electrically isolated from the control input terminals.

20. The isolated control interface of claim 19, wherein the isolated coupling means comprises:

pulse width modulator means (230) having a modulator input terminal (J227) and a modulator output terminal (J211), and optical coupling means (U401) having an optocoupler input terminal (J411) that is connected to the modulator output terminal.

21. The isolated control interface of claim 19, wherein the isolated coupling means produces a control output voltage between the control output terminals that has a first control output voltage magnitude when the control input terminals are shorted together, a second control output voltage magnitude when the control input terminals are unconnected, and a third control output voltage magnitude when an ac voltage is connected between the control input terminals; the second magnitude being greater than the first magnitude, and the third magnitude being greater than the first magnitude, but less than the second magnitude.

* * * * *